US006543877B1

(12) United States Patent
Boutet et al.

(10) Patent No.: US 6,543,877 B1
(45) Date of Patent: Apr. 8, 2003

(54) DIRECT PRINTING MACHINE BY INK JET ON A MEDIUM

(75) Inventors: Alain Boutet, Semeac (FR); Christophe Aliaga, Tarbes (FR)

(73) Assignee: Siantec Sarl, Tarbes (FR)

( * ) Notice: Subject to any disclaimer, the term of this patent is extended or adjusted under 35 U.S.C. 154(b) by 0 days.

(21) Appl. No.: 09/762,653

(22) PCT Filed: Aug. 10, 1999

(86) PCT No.: PCT/FR99/01963

§ 371 (c)(1),
(2), (4) Date: Apr. 12, 2001

(87) PCT Pub. No.: WO00/09339

PCT Pub. Date: Feb. 24, 2000

(30) Foreign Application Priority Data

Aug. 10, 1998 (FR) ..... 98 10250

(51) Int. Cl.[7] ..... B41J 2/165
(52) U.S. Cl. ..... 347/30; 347/29
(58) Field of Search ..... 347/30, 29, 32, 347/33, 22, 35, 43, 44, 56, 68, 86, 85, 100; 101/35; 400/174, 175, 320, 323.1

(56) References Cited

U.S. PATENT DOCUMENTS 3,960,072 A * 6/1976 Ahlgren et al. ..... 101/35
4,558,326 A 12/1985 Kimura et al. ..... 347/30
4,683,481 A * 7/1987 Johnson ..... 347/65
5,619,238 A * 4/1997 Higuma et al. ..... 347/86
6,302,516 B1 * 10/2001 Brooks et al. ..... 347/35

FOREIGN PATENT DOCUMENTS

| | | |
|---|---|---|
| EP | 0 322 131 | 6/1989 |
| EP | 0 754 555 | 1/1997 |
| FR | 2 707 919 | 1/1995 |
| JP | 61 024456 | 2/1986 |
| WO | 83 04393 | 12/1983 |
| WO | WO 96/15908 | * 5/1996 |

* cited by examiner

*Primary Examiner*—Shih-wen Hsieh
(74) *Attorney, Agent, or Firm*—Harrison & Egbert

(57) ABSTRACT

The invention concerns a direct printing machine by ink jet on a medium, including one or several printing heads with a spray nozzle, each head being dedicated to one shade. The invention is characterized in that the heads are borne by a pen carriage on the medium along three orthogonal axes X, Y and Z. Each of the heads is provided with a surge tank borne by the pen carriage, the surge tanks being supplied from one or several fixed tanks, the heads and the surge tanks are maintained in low pressure and the surge tanks are supplied with ink from the fixed tanks.

9 Claims, 6 Drawing Sheets

DIRECT PRINTING MACHINE BY INK JET ON A MEDIUM

BACKGROUND OF THE INVENTION

1. Field of the Invention

The invention presented here involves a machine for direct printing by projection of ink drops onto a medium 2. Description of the Related Art The ink jet technique is known from the prior-art.

It makes use of printing heads made of a piezo-electric ceramic having a chamber that, by deformation, projects the ink out of nozzles onto a medium. The projection of the ink can also be obtained, for certain types of ink, by heating that creates the formation of a gaseous bubble whose expulsion causes the ink jet.

These techniques are associated with microprocessor-controlled systems which make it possible to create, by ink projection, the desired image that can be, for example, a sign or an alphabetic letter or any other representation. These techniques are mainly used in office automation equipment.

In this equipment, the relative displacements of the printing head by the ink jets and the medium to be printed are low in amplitude, which does not harm the quality of the print. The necessary partial vacuum at the outlet of the projection nozzles is not affected by the low displacements. These technologies, however, are only suitable for certain types of specific inks and are not suitable for the projection of inks having a high corrosive capacity, the use of which is sought after for the quality of the printing obtained and for its unalterable adhesion on the medium or for inks to be developed by ultraviolet rays.

The invention intends to create a machine that allows equally the direct printing, by corrosive inks, i.e. having a solvent or ultraviolet base, on small formats or very large formats and on any type of medium, notably rigid, planar or formed The creation of a machine of this type that meets this definition is done by mastering a certain number of problems.

Since corrosive inks cannot be loaded into the known distributing cartridges of the HEWLETT PACKARD™ type or LEXMARK™. type, it is necessary to design a specific system for supplying ink using devices that make it possible to maintain a partial vacuum of 4 millibars at the level of the projection nozzles, without a variation in the pressure that would be detrimental to good printing, and this must be done independently of the given technique, by which the relative movements between the heads and the projection nozzles must be very fast. As an example, the heads and nozzles can be subjected to movement speeds of 800 millimeters per second and to accelerations of 5000 millimeters per second squared, which generates a pressure variation at the level of the nozzles.

Moreover, the nozzles functioning at a slight partial vacuum, with the variations mentioned above, are likely, in the course of the movement as a dynamic function, to pump out air bubbles.

This generates damage to their function that is causing stop of the projection, deflected jet, etc.

The invention presented here intends to provide a solution to this problem in creating a printing machine.

BRIEF SUMMARY OF THE INVENTION

For this purpose, the machine according to the invention for the direct printing functioning by projection of ink drops onto a medium, by one or more heads with projection nozzles, the machine being of a type having relative movements between the medium to be printed and the projection heads, each head being preferably dedicated to one color or to one ink, is characterized essentially in that:

- the head(s) is or are carried by a mobile carriage above the medium to be printed along the three axes X, Y, and Z orthogonally in space,
- each of the heads is equipped with a buffering reservoir carried by the mobile carriage, and
- the head(s) and their buffering reservoir are kept at a partial vacuum and the buffering reservoirs are supplied under pressure from one or more stationary reservoirs.

According to another characteristic of the invention, the mobile carriage guides the heads and the nozzles cyclically on a system for cleaning and maintenance of the heads which cleans the nozzles and primes them by suction, evacuates the excess drops by doctoring, and makes it possible to keep the nozzles in a good functioning condition.

According to yet another characteristic of the invention, the internal volume of each loaded buffering reservoir is divided in order to reduce the amplitude of waves produced by the movements of the reservoirs.

BRIEF DESCRIPTION OF THE SEVERAL VIEWS OF THE DRAWINGS

Other advantages and characteristics of the invention appear in reading the following description of an embodiment form of the invention given as a non-restrictive example and illustrated by the attached drawings.

DETAILED DESCRIPTION OF THE INVENTION

Figure 1:
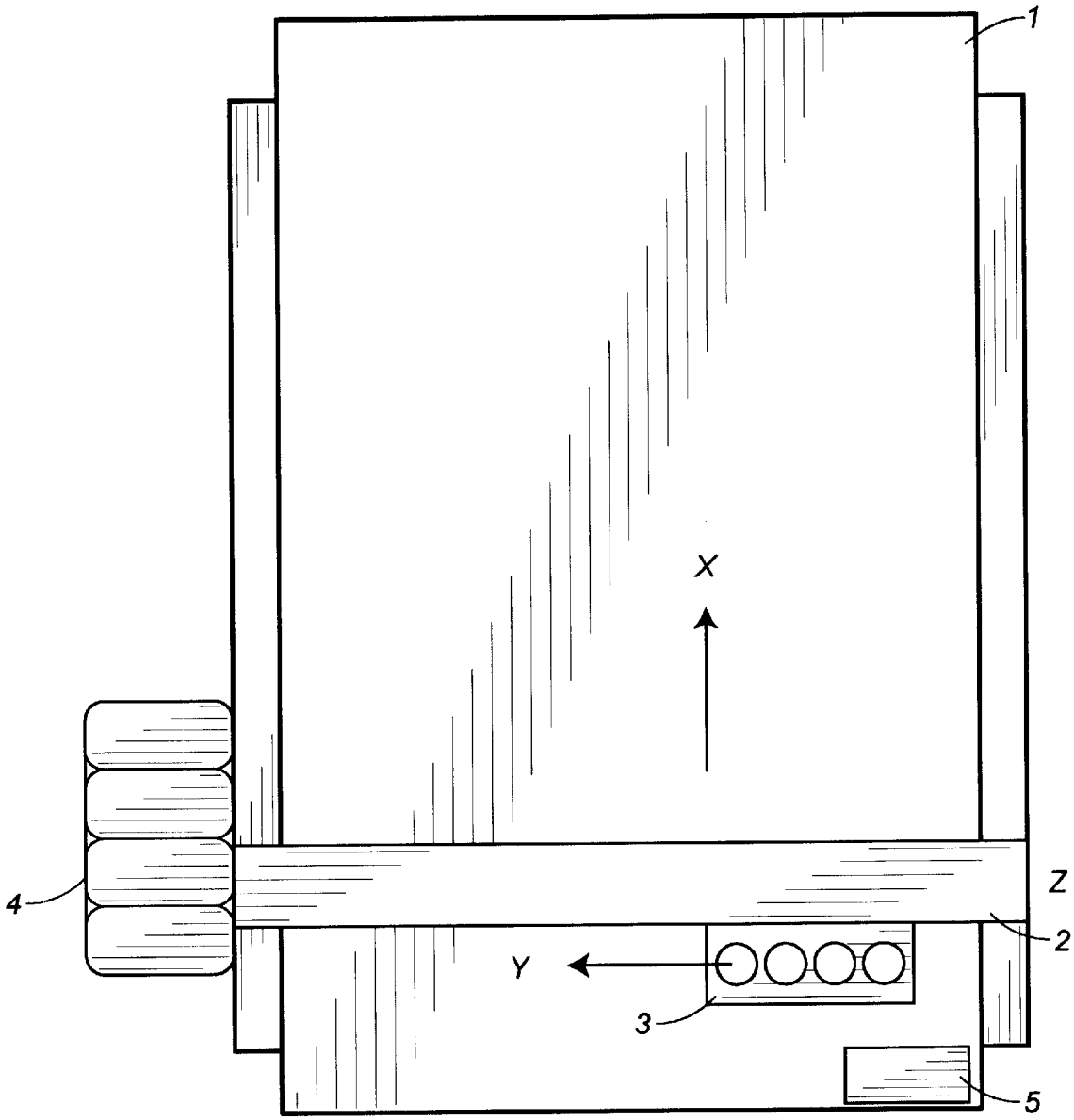
FIG. 1 is a schematic planar view of a machine according to the invention.

As shown schematically in the planar view in FIG. 1, the machine according to the invention consists of a rectangular table I consisting of a planar, horizontal plate in a rectangular shape on which the medium is arranged prior to receiving the printing. A transverse frame 2 is mobile in the direction X on the table.

On the frame 2, a loaded carriage 3 is mounted that is mobile by any known mechanism along the Y axis and the Z axis, where the X, Y, and Z axes are orthogonal in space. The mobile carriage can thus be moved in all directions on the table 1 and in height along Z relative to it.

These movements are controlled by a command and control unit consisting of a microprocessor with connected equipment. The position of the mobile carriage, notably in height, relative to the table is regulated by any detection system of a known type.

From the side of the table, one or more reservoirs 4 is/are arranged to be stationary so as to receive the inks used and supply, by conduits 7, the reservoir(s) 6 of the mobile carriage 3, these reservoirs 6 being located lower than the reservoir(s) 4.

Arranged stationary on the table 1 is a system 5 for cleaning the heads and plates of the projection nozzles.

Figure 2:
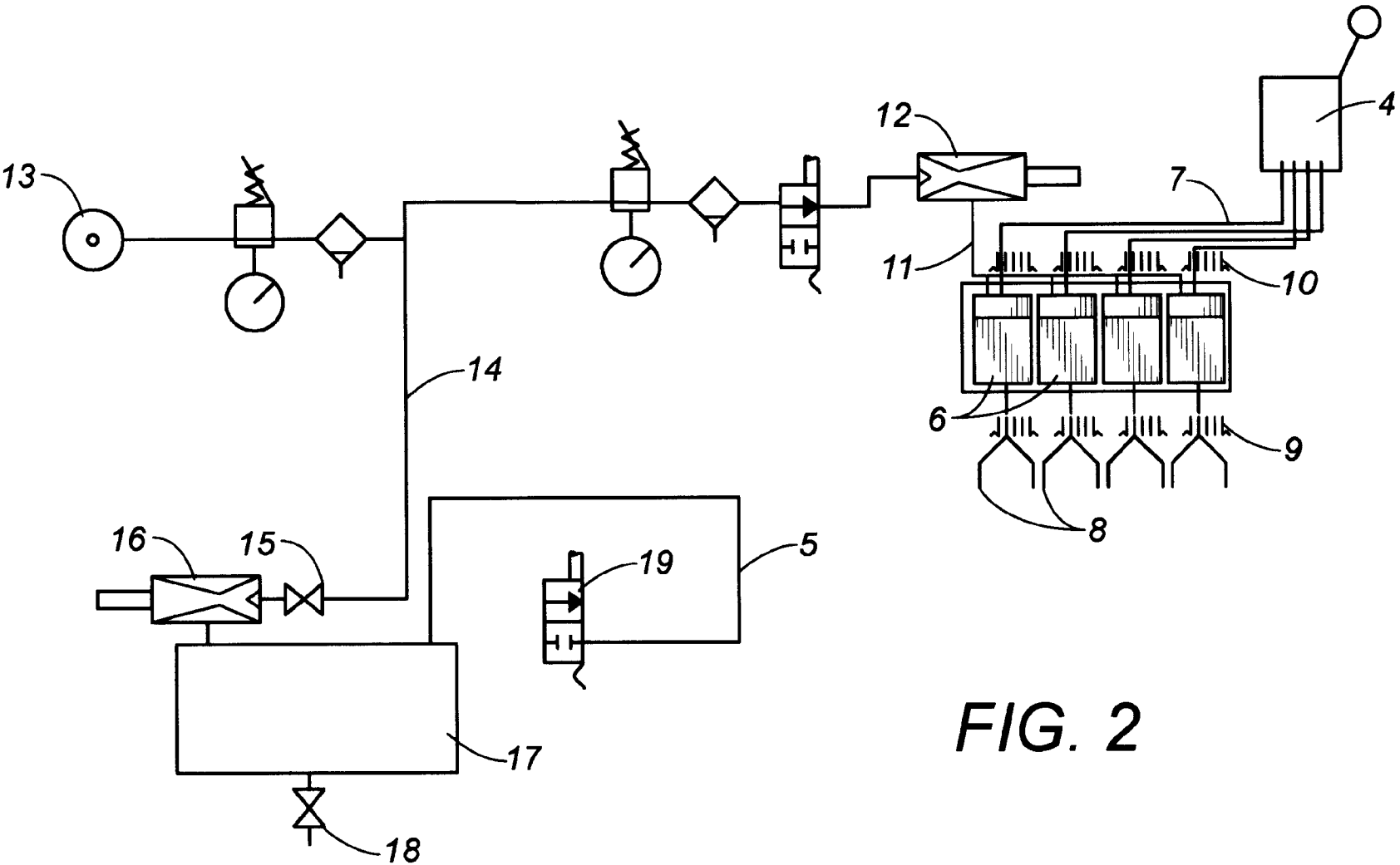
FIG. 2 is a schematic view representation of the hydraulic system of the machine according to the invention.

The loaded carriage 3 is shown in greater detail in FIG. 2 with the hydraulic system.

The high-velocity mobile loaded carriage consists of one Or more buffering reservoirs 6.

Shown in the example of FIG. 2 are four buffering reservoirs 6, each of them being dedicated to one color of ink or to one shade of ink functioning to compose a color, each of them being connected by a conduit line 7 to the stationary reservoir 4, which consists of as many chambers and lines as there are buffering reservoirs.

Downstream from each buffering reservoir are correspondingly one or two ink projection heads based on a piezoelectric or other system, each head supplying its projection nozzles that are carried by a nozzle plate. According to the preferred embodiment form, each buffering reservoir 6 supplies only one projection head. In addition, the buffering reservoirs 6 are independent from each other and are mounted in a removable manner on the mobile carriage. This arrangement, while allowing the individual replacement of each reservoir, makes the maintenance of the assembly easier, In the same spirit, a similar device is provided for the projection heads and the associated nozzles. Another advantage in the removability of the reservoirs 6 and the projection heads resides in the improvement of the flexibility of the use of the printing machine.

Thus, each reservoir 6 and associated projection head can now be affected by only one, color and only one category of ink. Thus, you avoid the obligation of a complete cleaning of the reservoirs and the heads prior to the replacement of the ink, justified by problems of chemical and/or physical incompatibility that can exist between the inks of different categories and/or different colors.

The reference item 8 indicates the connections of each of the heads that are supplied by a controlled electrodistributor 9 downstream from each of the buffering reservoirs 6. The distributors 9 are controlled individually by the command and control unit. By the command of the electrodistributors, the communication between the buffering reservoirs and the associated projection heads is interrupted or established, and thus the supply in ink from the pulverization nozzles is interrupted or established. These electrodistributors are controlled independently from each other.

Upstream from each of the buffering reservoirs 6, on each of the supply lines 7 from the stationary reservoir 4, a controlled electrodistributor 10 controlled by the command and control unit is mounted. By controlling each one of these electrodistributors, the communication between the associated reservoirs 4 and 6 is established or interrupted and thus the supply or not of the reservoir 6 with ink.

In a manner so as to detect the level of ink in the reservoir and to order the supply of ink when the level is at a minimum and to interrupt this supply when the level is at maximum, a level detector is combined with the reservoir 6 and is designed to transmit two distinct electronic signals, one of which is representative of a minimum level and the other is representative of a maximum level. This level detector is connected electronically to the command and control unit in order to transmit to this unit the maximum and minimum level signals.

As can be seen in FIG. 2, the buffering reservoirs 6 can be kept in a partial vacuum by a line 11 shared with the mechanism for implementing a partial vacuum 12, where this line is connected to a compressor 13. This mechanism for implementing a partial vacuum is advantageously made up of a device using the Venturi effect. Such a device, itself known from the prior-art, consists of a first internal channel provided along one of its ends with a compressed air intake opening and along its other end with a compressed air outlet opening The end of a second channel, which is connected by its other end to line 11, opens radially into this internal channel. By the passage of an air flow into the first channel, an aspiration effect, generator of the partial vacuum, is created in the second channel.

The line 11 is equipped, between the compressor 13 and the device using the Venturi effect 12, with mechanisms for supplying and controlling, such as a filter, regulator, and manometer of the known types that are not described here.

A bypass 14 connected on the line 11 is joined, by the intermediary of a controlled stopcock 15, to a device using the Venturi effect 16 which sets a partial vacuum in the reservoir 17 with a drain cock 18.

The reservoir at partial vacuum 17 is connected by an electrodistributor 19 to the system 5 for the cleaning and maintenance of the ink pr jection nozzles.

The device using the Venturi effect 12 on the line 11 keeps the buffering reservoir at partial vacuum.

According to another embodiment form, each buffering reservoir 6 is equipped with its own mechanism for creating a partial vacuum. This mechanism for creating a partial vacuum is made up advantageously of a device using the Venturi effect 12 such as the one previously described. The aspiration opening of this device using the Venturi effect is connected directly by its aspiration opening to a hole passing through the upper wall of the buffering reservoir 6 Thus, a partial vacuum is created in the upper part of the reservoir 6, above the level of the ink.

According to a first embodiment form, the buffering reservoirs are supplied with ink by the lines 7, the ink supply pressure being on the order of 0.1 to 0.2 bar.

According to a second embodiment form, each buffering reservoir 6 is supplied with ink by an additional reservoir 34 that belongs to it, where the additional reservoir 34 is connected to the corresponding conduit 7 by the corresponding electrodistributor 10 This additional reservoir, for example, in the form of a cylinder, consists of a bottom wall, a surrounding wall that is vertically erected on the bottom wall, and a blocking cover that comes to rest on the upper horizontal groove of the surrounding wall in order to block the opening that defines the wall at this level. The additional reservoir 34 accommodates the level detector device and is connected to the buffering reservoir 6 by a lower conduit 34*a* located below the minimum ink level and by an upper conduit 34*b* located above the level of ink that allows respectively the supply in ink of the buffering reservoir 6 and the equilibrium of air pressures in the two reservoirs. Preferentially, the conduits 34*a* and 34*b* ensure a rigid mechanical connection between the buffering reservoir 6 and the additional reservoir 34. Thus, these two reservoirs 6 and 34 both together comprise a removable assembly that is all in one piece.

Figure 9:
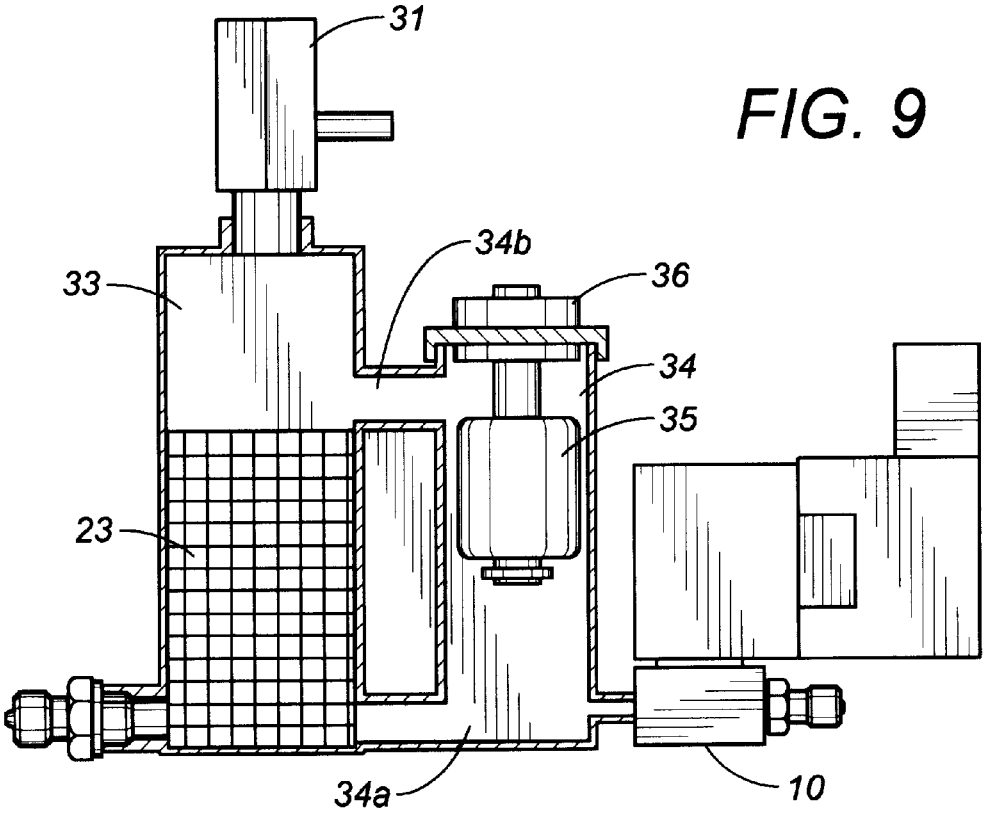
FIG. 9 shows a sectional view of a buffering reservoir and an additional reservoir.

As can be seen in FIG. 9, the lower part of the surrounding wall of the additional reservoir is equipped with a hole passing through to which the outlet opening of the electrodistributor 10 is connected. This additional reservoir is thus located so that it is supplied from the bottom. This thus avoids, when the ink is supplied, the formation of waves and shock waves, generated from variations in ink pressure in the additional reservoir 34 and in the buffering reservoir 6.

The level detector is advantageously made up of a float 35 and a sensor 36 of the float position. This sensor is connected electrically to the command and control unit, and it is fitted to transmit to the unit a minimum level signal and a maximum level signal. This detector is carried by the cover of the additional reservoir 34.

The projection heads function at a slight partial vacuum. It is necessary for the regularity of the printing that this partial vacuum remains constant at around minus 4 millibars or is subject to lower possible variations, a variation from minus four to minus eight millibars being acceptable.

It is necessary that there be, in each of the buffering reservoirs 6, independently of the variations in the ink level and the movement of it in each reservoir, due to the fact of the movement of the loaded carriage carrying them, a minimum of change in the partial vacuum in order to avoid variations in the partial vacuum at the outlet of the nozzles which would generate printing disorders.

For this purpose, each buffering reservoir 6 is divided in order to prevent the formation of waves.

Figure 3:
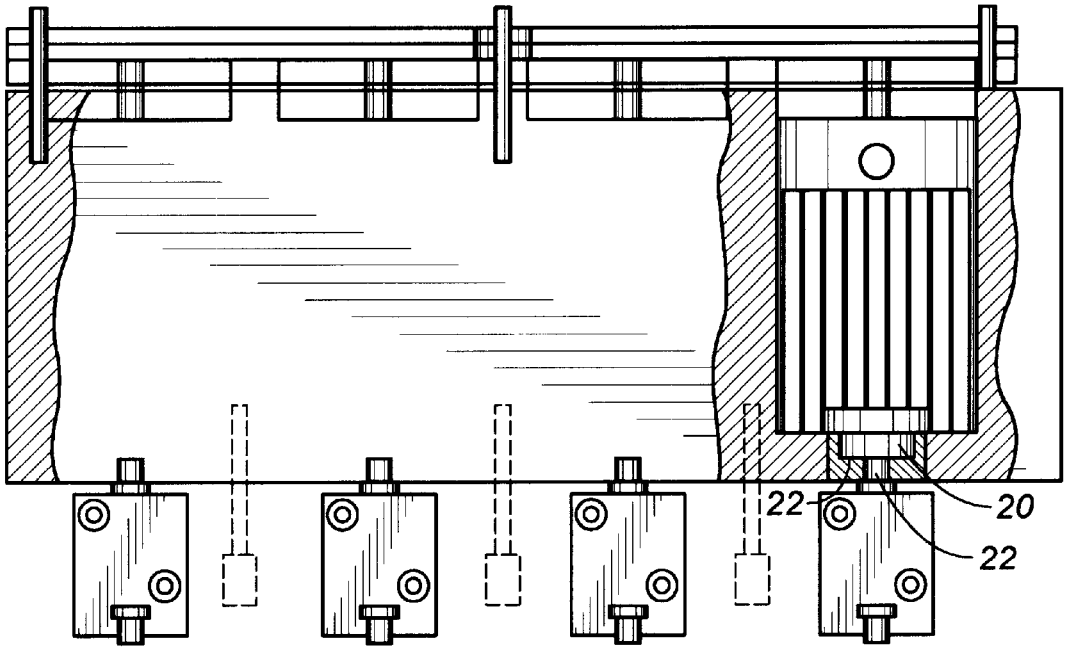
FIG. 3 is a schematic view of the buffering reservoirs with the projection head.
Figure 4:
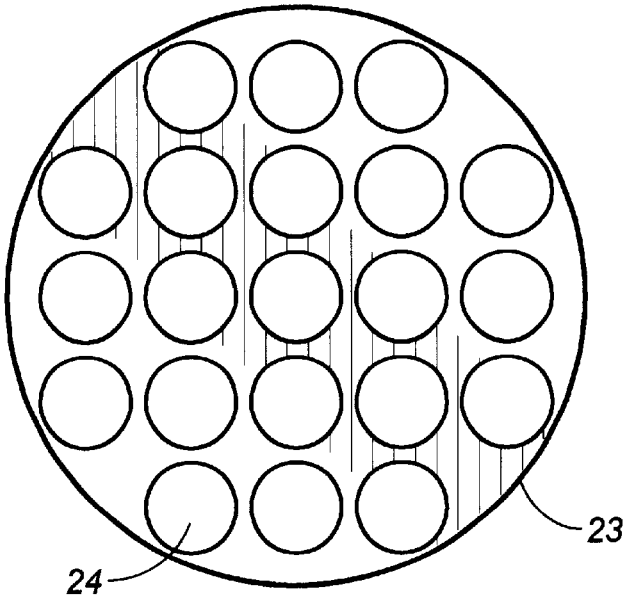
FIGS. 4 and 5 are planar and sectional views respectively of the insert divider introduced into each of the reservoirs.

FIG. 3 shows a section view of an buffering reservoir among the four loaded buffering reservoirs 6.

Each buffering reservoir 6 preferably has a cylindrical volume whose highest point is blocked and whose bottom 20 is restricted around the electrodistributor and the head.

For this purpose, the bottom wall 21 of each buffering reservoir has a cylindrical volume at a low height and a smaller diameter than that of the reservoir with an outlet nozzle 22.

In the cylindrical volume of each of the buffering-reservoirs 6, a dividing device 23 is introduced which breaks it down into several small reservoirs and performs a function of a wave breaking damping device.

Figure 5:
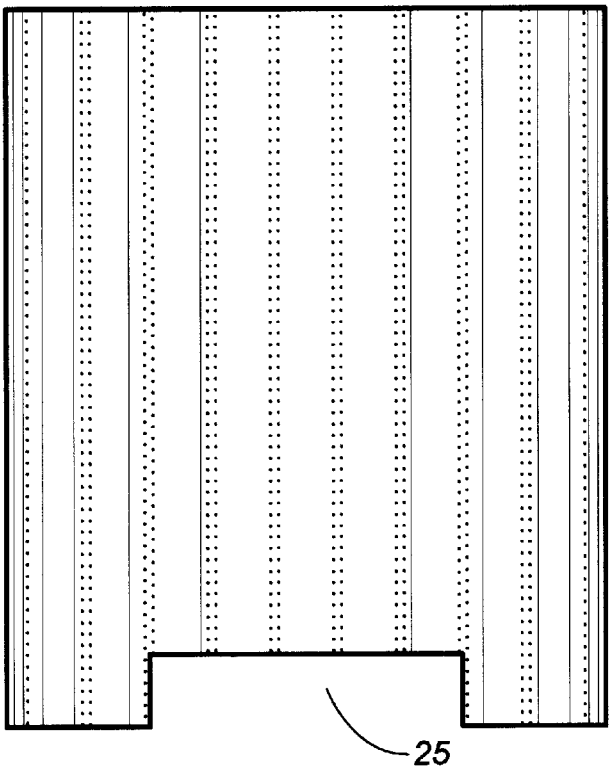
Figure 6:
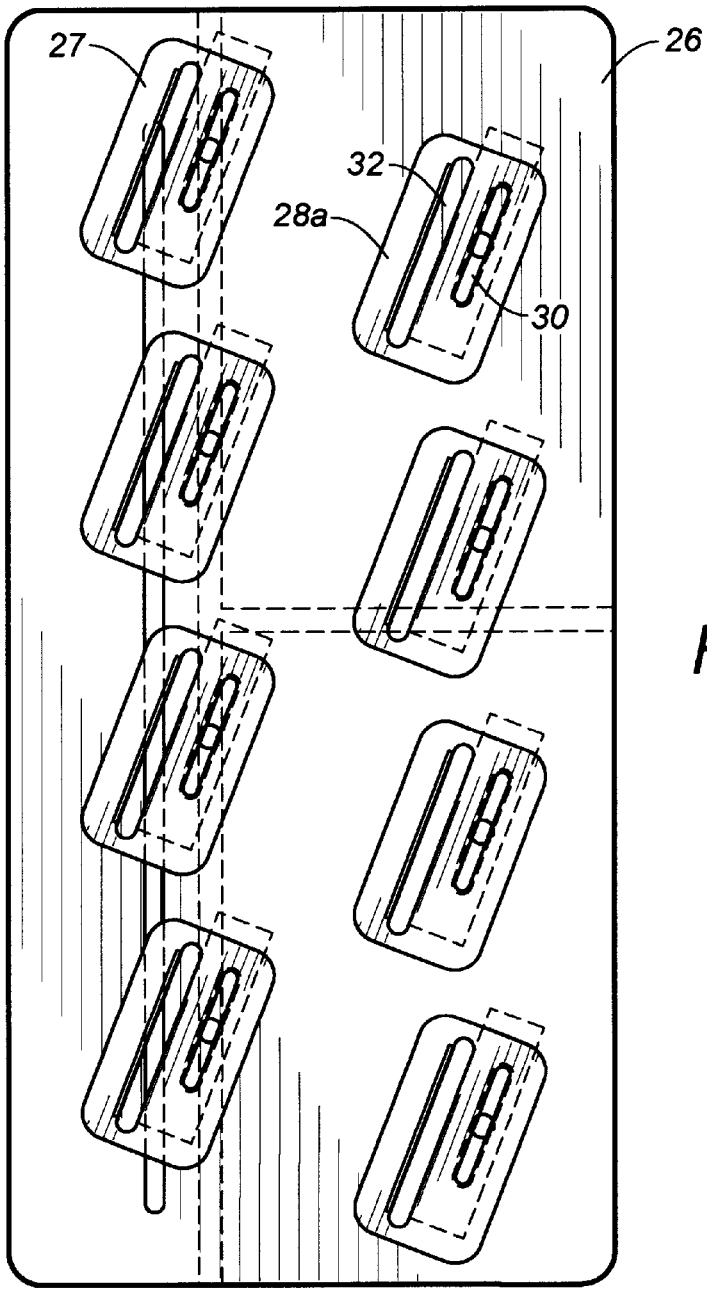
FIG. 6 shows in a planar view the system for cleaning and maintenance of the heads and projection nozzles which is linked to the hydraulic circuit.

As shown in FIGS. 5 and 6, the divider device is a block having a section corresponding to that of the internal volume of the buffering reservoir which is equipped from top to bottom with parallel channels 24 that define as many small reservoirs.

Advantageously, the divider has at its bottom, a recess 25 that makes the circulation of ink easier.

It goes without saying that any other system creating a division and a partitioning of the reservoir can be adapted.

The buffering-reservoirs 6 and additional reservoirs, the dividers and the covers are made of a suitable material, resistant to the ink solvents used.

Figure 7:
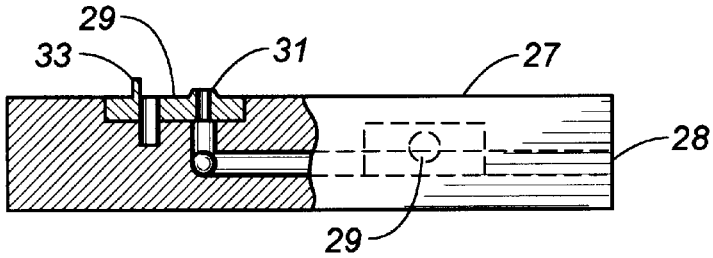
FIG. 7 is a sectional view of the device shown in FIG. 6.
Figure 8:
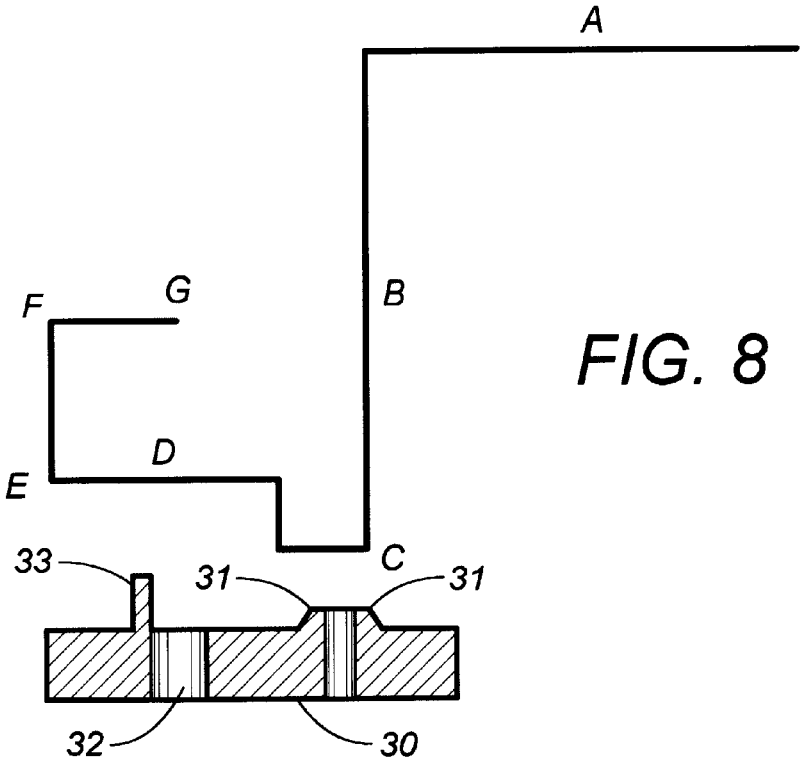
FIG. 8 is a schematic view of the maintenance cycle.

The device for cleaning the nozzle plates and maintaining the nozzles connected to the compressor by the bypass 14 (FIG. 2) and shown schematically in position in FIG. 1 is represented in detail in FIGS. 7 and 8. On this plate, reserved aware arranged in the shape of a rectangle 27. Two channels 28 and 29, connected by conduits to the reservoir 17 at partial vacuum, open into each of the reserved areas.

The reserved areas 27 are aligned and offset at a slant relative to their axis of alignment.

The reserved areas 27 each accommodate a plate 28*a* made of a flexible material, for example, silicone.

The plate 28*a* has two parallel oblong openings at a slant.

A first short opening 30 corresponds to a conduit nozzle 28. The opening 30 is equipped with two lips 31 having a low height.

A second oblong opening 32 corresponds to the conduit 29. This opening 32 has a lip for doctoring 33.

The maintenance cycle of the heads and nozzles is shown in FIG. 8 in a continuous line, the different stages of die cycle and the displacement of the head or the heads being shown by the letters A, B, C, D, E, F and G.

At A, the projection head is guided at a speed V1 above the lips 31 of the opening 30.

At B, the head is lowered at a speed V2 onto the lips 31.

At C, the partial vacuum at the head is interrupted. The suction is implemented by the action of the device using the Venturi effect 16 over a time T1.

At D, the head is brought back up by a value of 2 millimeters above the lips 31, the suction is stopped, the partial vacuum is started again.

At E, the head is moved at a speed V2 above the doctoring lip 33.

At F, the head is brought back up again at a speed V3.

At G, the head is placed above the maintenance and opening zone 32, and the spitting out of the rasters, i.e. of a quantity of ink over a time T, is started.

The maintenance cycle allows the cleaning of the nozzles and the nozzle plates and priming the heads and nozzles while preventing them from becoming sealed, for example, by the evaporation of solvents.

Finally, in order to avoid the migration of inks between the different printed zones on the medium, a prepolymerization is performed. For this purpose, behind the projection heads, the machine is equipped with a mechanism fitted to create a polymerization of the ink affixed on the medium, where this mechanism can be made up of a source for radiating ultraviolet light oriented towards the medium. Any other suitable mechanism can be used.

What is claimed is:

1. A machine for direct printing with a corrosive ink having a solvent base comprising:

a table;

a medium supported on said table;

at least one head having a projection nozzle;

a carriage means positioned in front of said medium, said carriage means for carrying the head thereon so as to have relative movement between said medium and the projection nozzle along orthogonal axes;

at least one buffering reservoir connected to the head and carried on said carriage means;

a vacuum means connected to the head for creating a partial vacuum at one end of said projection nozzle without a variation in pressure, said vacuum means for keeping the head and the buffering reservoir at a partial vacuum;

at least one stationary reservoir means connected to the buffering reservoir for supplying the ink to the buffering reservoir;

a compressor means connected by a line to the buffering reservoir, said compressor means having a venturi for creating the partial vacuum to the buffering reservoir, the buffering reservoir being supplied with the ink through another line from the stationary reservoir means; and a bypass line connected to said line between said compressor means and the buffering reservoir; and a cleaning means connected to said bypass line, said cleaning means having a venturi for passing a cleaning fluid therethrough and into said bypass line.

2. The machine of claim 1, the buffering reservoir having an interval volume in which is divided.

3. The machine of claim 2, said internal volume being divided by a partition.

4. The machine of claim 1, further comprising:

a reservoir located between said cleaning means and said venturi of said cleaning means, said reservoir being at a partial vacuum.

5. The machine of claim 1, said cleaning means comprising a suction opening and an oblong opening cooperative with the head.

6. The machine of claim 5, said suction opening having lips extending therefrom.

7. The machine of claim 5, said oblong opening having a lip extending therefrom.

8. The machine of claim 1, further comprising;

polymerization means positioned behind the head for polymerizing the ink affixed on said medium.

9. A machine for direct printing with a corrosive ink having a solvent base comprising:

a table;

a medium supported on said table;

at least one head having a projection nozzle;

a carriage means positioned in front of said medium, said carriage means for carrying the head thereon so as to have relative movement between said medium and the projection head along orthogonal axes;

at least one buffering reservoir connected to the head and carried on said carriage means;

a vacuum means connected to the head for creating a partial vacuum at one end of said projection nozzle without a variation in pressure, said vacuum means for keeping the head and the buffering reservoir at a partial vacuum;

at least one stationary reservoir means connected to the buffering reservoir for supplying the ink to the buffering reservoir; and an additional reservoir means connected to the buffering reservoir by a lower conduit located below a minimum ink level and by an upper conduit located above the ink level, said additional reservoir means for supplying ink to the buffering reservoir and for allowing an equilibrium of air pressure with the buffering reservoir.

* * * * *